US011401943B2

(12) United States Patent
Horng et al.

(10) Patent No.: US 11,401,943 B2
(45) Date of Patent: Aug. 2, 2022

(54) IMPELLER WITH REINFORCED BLADES

(71) Applicant: SUNON ELECTRONICS (KUNSHAN) CO., LTD., Jiangsu (CN)

(72) Inventors: Alex Horng, Kaohsiung (TW); Chi-Min Wang, Kaohsiung (TW)

(73) Assignee: SUNON ELECTRONICS (KUNSHAN) CO., LTD., Kunshan (CN)

( * ) Notice: Subject to any disclaimer, the term of this patent is extended or adjusted under 35 U.S.C. 154(b) by 18 days.

(21) Appl. No.: 16/907,550

(22) Filed: Jun. 22, 2020

(65) Prior Publication Data

US 2021/0047931 A1 Feb. 18, 2021

(30) Foreign Application Priority Data

Aug. 13, 2019 (TW) ..... 108128765

(51) Int. Cl.

| | |
|---|---|
| ***F04D 29/28*** | (2006.01) |
| ***F01D 5/14*** | (2006.01) |
| ***F04D 29/32*** | (2006.01) |
| ***F04D 29/34*** | (2006.01) |

(52) U.S. Cl.

CPC ..... *F04D 29/281* (2013.01); *F01D 5/147* (2013.01); *F04D 29/329* (2013.01); *F04D 29/34* (2013.01); *F05D 2240/305* (2013.01); *F05D 2240/306* (2013.01)

(58) Field of Classification Search

CPC .. F04D 29/281; F04D 29/30; F05D 2240/305; F05D 2240/306

See application file for complete search history.

(56) References Cited

U.S. PATENT DOCUMENTS

| | | | | |
|---|---|---|---|---|
| 6,382,915 | B1 * | 5/2002 | Aschermann | F04D 25/022 416/169 A |
| 6,565,320 | B1 * | 5/2003 | Suris | F04D 29/384 416/175 |
| 6,726,454 | B2 * | 4/2004 | Blass | F04D 29/329 416/236 R |
| 7,086,837 | B2 | 8/2006 | Kamoshita et al. | |
| 8,092,170 | B2 * | 1/2012 | Hwang | F04D 25/0613 415/220 |
| 8,647,051 | B2 | 2/2014 | O'Connor et al. | |
| 8,961,107 | B2 | 2/2015 | Su et al. | |
| 9,033,674 | B2 | 5/2015 | Jang et al. | |
| 9,217,443 | B2 * | 12/2015 | He | F04D 29/329 |
| 9,222,482 | B2 * | 12/2015 | Huang | F04D 25/0613 |
| 2008/0130226 | A1 | 6/2008 | Yamashita et al. | |

FOREIGN PATENT DOCUMENTS

| | | |
|---|---|---|
| CN | 110005638 A | 7/2019 |
| JP | H8159092 A | 6/1996 |

* cited by examiner

*Primary Examiner* — Ninh H. Nguyen

(74) *Attorney, Agent, or Firm* — Alan D. Kamrath; Karin L. Williams; Mayer & Williams PC

(57) ABSTRACT

An impeller includes a hub, a plurality of blades coupled with the hub, and a plurality of ribs connected to the plurality of blades. Each of the plurality of ribs has a connecting end coupled with the hub. Each of the plurality of blades intersects with at least one of the plurality of ribs.

19 Claims, 4 Drawing Sheets

IMPELLER WITH REINFORCED BLADES

CROSS REFERENCE TO RELATED APPLICATION

The application claims the benefit of Taiwan application serial No. 108128765, filed on Aug. 13, 2019, and the entire contents of which are incorporated herein by reference.

BACKGROUND OF THE INVENTION

1. Field of the Invention

The present invention generally relates to an impeller and, more particularly, to an impeller having ribs connected to the blades thereof.

2. Description of the Related Art

As thinness, lightness and high performance are required for the development of the electronic devices, miniaturization of the cooling fan is needed in addition to providing the electronic devices with the cooling function. Therefore, the size of the conventional cooling fan is usually reduced by reducing the thickness of the blades of the impeller.

However, although the minimization of the conventional cooling fan can be carried out by reducing the thickness of the blades of the impeller, this lowers the strength of the blades and adversely affects the stability of rotation. As a result, shaking or even deformation of the blades tends to result due to the air resistance, causing severe shaking and large noise and deteriorating the stability of the cooling fan.

In another type of the cooling fan, a ring is connected to a free end of each blade. Through the interconnection between the blades of the impeller, the blades of the impeller can be secured in position. However, as the strength of the blades is lowered due to the reduced thickness of the blades, the interconnection of the blades through the use of the ring still cannot sufficiently secure the blades in position.

SUMMARY OF THE INVENTION

It is therefore the objective of this invention to provide an impeller which avoids the shaking of the blades during the rotation of the impeller.

As used herein, the term "one" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "join", "assembly" or the like is used to include separation of connected members without destroying the members after connection or inseparable connection of the members after connection. A person having ordinary skill in the art would be able to select the type of connection according to desired demands in the material or assembly of the members to be connected.

In an aspect, the impeller according to the invention includes a hub, a plurality of blades coupled with the hub, and a plurality of ribs connected to the plurality of blades. Each of the plurality of ribs has a connecting end coupled with the hub. Each of the plurality of blades intersects with at least one of the plurality of ribs.

Based on the above, the plurality of blades of the impeller according to the invention can be secured in position through the interconnection between the blade and at least one rib that extends from the outer periphery of the hub and connects to the blades, preventing shaking or deformation of the plurality of blades resulting from the air resistance during the rotation of the impeller. As such, the noise can be reduced and the cooling performance can be improved.

In the example, each of the plurality of blades has a first end and a second end. The first ends of the plurality of blades are coupled with the hub. Each of the plurality of blades has a first blade edge and a second blade edge opposite to the first blade edge. The first blade edge and the second blade edge of each of the plurality of blades are located between the first end and the second end of the blade. The plurality of ribs is located between the first blade edges and the second blade edges of the plurality of blades. As such, the plurality of blades can be secured in position.

In the example, each of the plurality of ribs is connected to at least one of the plurality of blades. The plurality of ribs is connected to the first blade edge or the second blade edge of the blades. As such, the plurality of blades can be secured in position.

In the example, each of the plurality of ribs is connected to the at least one of the plurality of blades in a manner that one surface of the rib is flush with the first blade edge or the second blade edge of each of the at least one of the plurality of blades. As such, the plurality of blades can be secured in position.

In the example, each of the plurality of blades has a first end and a second end. The first ends of the plurality of blades are coupled with the hub. Each of the plurality of blades has a first blade edge and a second blade edge opposite to the first blade edge. The first blade edge and the second blade edge of each of the plurality of blades are located between the first end and the second end of the blade. Each of the plurality of ribs is connected to at least one of the plurality of blades in a manner that the rib is partially or entirely protrusive from the first blade edge or the second blade edge of each of the at least one of the plurality of blades in an axial direction of the impeller. As such, the plurality of blades can be secured in position.

In another example, each of the plurality of blades has a first end and a second end. The first ends of the plurality of blades are coupled with the hub. Each of the plurality of blades has a first blade edge and a second blade edge opposite to the first blade edge. The first blade edge and the second blade edge of each of the plurality of blades are located between the first end and the second end of the blade. The plurality of ribs is connected to the first blade edges and the second blade edges of the plurality of blades. As such, the plurality of blades can be further secured in position.

In an implementation of the other example, the plurality of ribs includes at least one first rib connected to the first blade edges of a portion of the plurality of blades, as well as at least one second rib connected to the second blade edges of the portion of the plurality of blades. The at least one first rib is aligned with the at least one second rib. As such, the plurality of blades can be further secured in position.

In another implementation of the other example, the plurality of ribs includes at least one first rib connected to the first blade edges of a portion of the plurality of blades, as well as at least one second rib connected to the second blade edges of the portion of the plurality of blades. The at least one first rib is staggered from the at least one second rib. As such, the plurality of blades can be further secured in position.

In an implementation of the example, each of the plurality of ribs has a protruding end opposite to the connecting end and extending in a direction in which the second end of the blade extends, each of the plurality of ribs further includes a fixed section between the connecting end and the protruding end of the rib, and the fixed section is in a linear form and is connected to a portion of the plurality of blades. As such, the plurality of blades can be further secured in position.

In another implementation of the example, each of the plurality of ribs has a protruding end opposite to the connecting end and extending in a direction in which the second end of the blade extends, each of the plurality of ribs further includes a fixed section between the connecting end and the protruding end of the rib, and the fixed section is in a curved form and is connected to a portion of the plurality of blades. As such, the curved form of the fixed section allows for a longer extension path of the rib as it matches the circular shape of the impeller, advantageously securing the plurality of blades in position.

In the example, the fixed section has a top surface and a bottom surface opposite to the top surface in an axial direction, the fixed section has two lateral surfaces opposite to each other along a plane perpendicular to the axial direction, and each of the two lateral surfaces is an arched surface. As such, when the rib is adjacent to the windward position of the blade, the rib is able to guide the air to flow. This advantageously lowers the undesired air-blocking effect of the rib.

In the example, the protruding end of each of the plurality of ribs is located between the hub and the second ends of the plurality of blades. As such, the radial extension length of the plurality of ribs over the plurality of blades is reduced, thereby increasing the windward areas of the plurality of blades. Advantageously, the balance between the stability and the air volume of the plurality of blades is maintained.

In the example, a ratio of a radial distance, which is measured from a lateral wall of the hub to the protruding end of each of the plurality of ribs, to a radial distance from the lateral wall of the hub to the second end of one of the plurality of blades, is 0.3~1. As such, the windward areas of the plurality of blades are increased under the interconnection between the blade and at least one of the plurality of ribs, thereby maintaining the balance between the stability and the air volume of the plurality of blades.

In the example, the fixed section extends from the first blade edges of the portion of the plurality of blades towards the second blade edges of the portion of the plurality of blades. As such, the plurality of blades can be further secured in position.

In the example, the impeller further comprises an annular rib connected to the second ends of the plurality of blades. As such, shaking of the plurality of blades at the second ends thereof can be prevented.

In the example, each of the plurality of blades intersects with at least two of the plurality of ribs. As such, the plurality of blades can be further secured in position.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
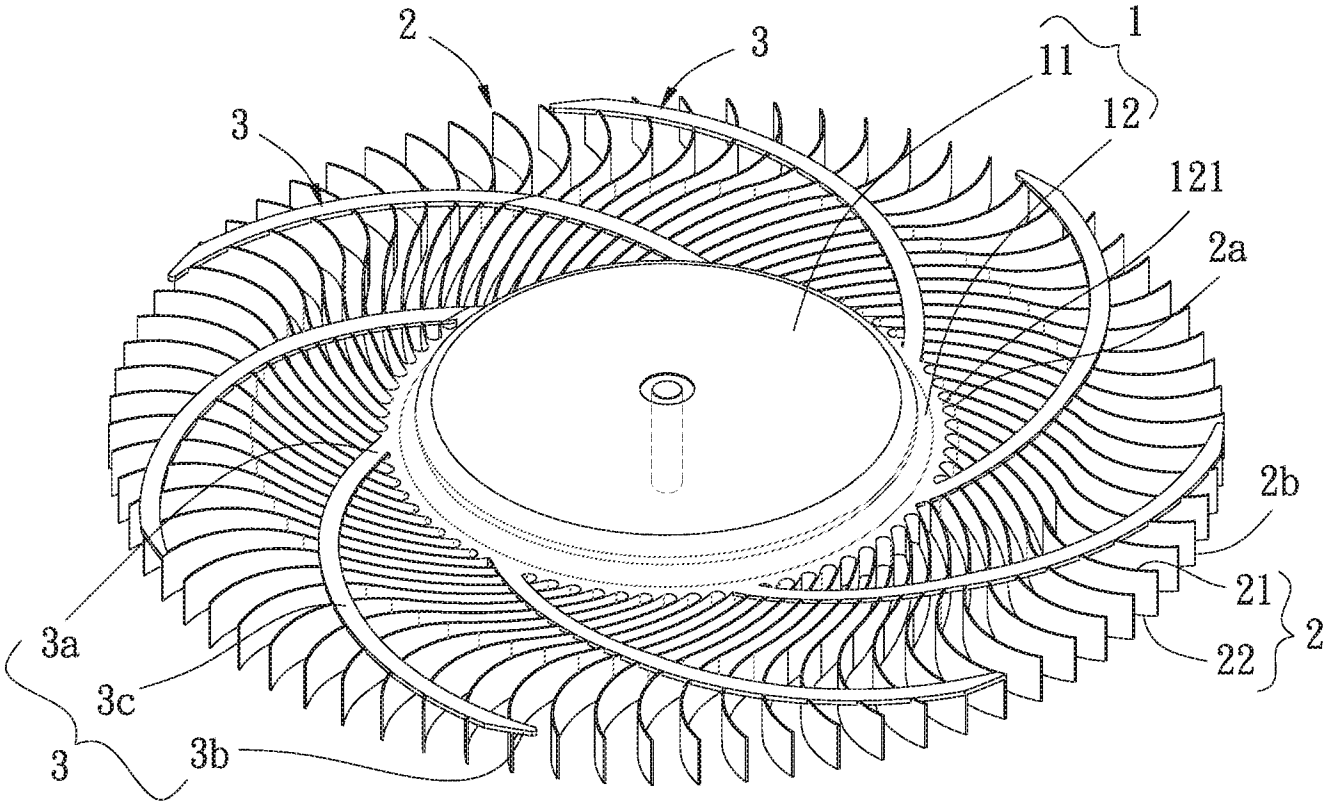
FIG. 1 is a perspective view of an impeller according to a first embodiment of the invention.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

FIG. 1 shows an impeller according to a first embodiment of the invention. The cooling module includes a hub 1, a plurality of blades 2 coupled with the outer periphery of the hub 1, and a plurality of ribs 3 connected to the plurality of blades 2. The impeller of the invention can be used to constitute a centrifugal fan or an axial fan. The following example is made with the centrifugal fan, but it is not used to limit the invention.

The hub 1 has a top 11 to which a shaft of a fan can be attached. For example, the hub 1 can be made of plastic material such that the top 11 can be formed with the shaft in injection molding. Alternatively, the hub 1 can be made of a metal material such that the top 11 can be engaged with the shaft by press fitting, laser welding, or the like. These approaches are not described herein as they can be readily appreciated by one of ordinary skill in the art. The hub 1 may have a lateral wall 12. The lateral wall 12 can be coupled with the outer periphery of the top 11, such that the top 11 and the lateral wall 12 jointly delimit a space for accommodation of the elements such as the magnets and the stator. The plurality of blades 2 can be coupled with the lateral wall 12. In this embodiment, the lateral wall 12 can include an extension portion 121 extending radially outwards from the lateral wall 12 (away from the shaft) and connecting to the plurality of blades 2. For example, the extension portion 121 is made of plastic material to envelope the lateral wall 12. In this arrangement, under the reduced thickness of the plurality of blades 2, the extension portion 121 and the lateral wall 12 of the hub 1 are engaged with each other in larger areas, thereby reinforcing the engagement of the plurality of blades 2 and effectively preventing breakage of said blades 2.

The plurality of blades 2 can form with the extension portion 121 in injection molding. For example, the plurality of blades 2 is made of liquid crystal polymer, preferably mixed with carbon fiber, mineral fiber, or the mixture of mineral fiber and glass fiber. Alternatively, the plurality of blades 2 may be made by injection molding from polymer adhesive mixed with the metal powder such as iron, aluminum, copper or metal alloy, thereby enhancing the structural strength of the plurality of blades 2. In this embodiment, the thickness of the blade 2 is 0.05-0.2 mm to maintain the fan in a slim fashion. In this regard, the number of the plurality of blades 2 is preferably equal to or larger than 70, such that the thin blades 2 can generate a sufficient flow of air. Each blade 2 has a first end 2*a* coupled with the lateral wall 12 of the hub 1, as well as a second end 2*b* facing away from the hub 1. Each blade 2 has a first blade edge 21 and a second blade edge 22 between the first end 2*a* and the second end 2*b* thereof. A plurality of ribs 3 may be connected to the first blade edge 21 and the second blade edge 22. The plurality of blades 2 may have various implementations. For example, the first end 2*a* and the second end 2*b* can be radially aligned with each other; namely, a line that radiates from the shaft of the hub 1 passes through the first end 2*a* and the second end 2*b* of the blade 2. In this regard, the plurality of blades 2 is radially coupled with the hub 1. Alternatively, the line that radiates from the shaft of the hub 1 may not pass through the first end 2*a* and the second end 2*b* of the blade 2. In this situation, the blade 2 may be tangentially coupled with the lateral wall 12 of the hub 1. However, the invention is not limited to either of the above options. In this embodiment, the blade 2 curves inversely such that the plurality of blades 2 can provide an improved air-guiding effect.

Figure 2:
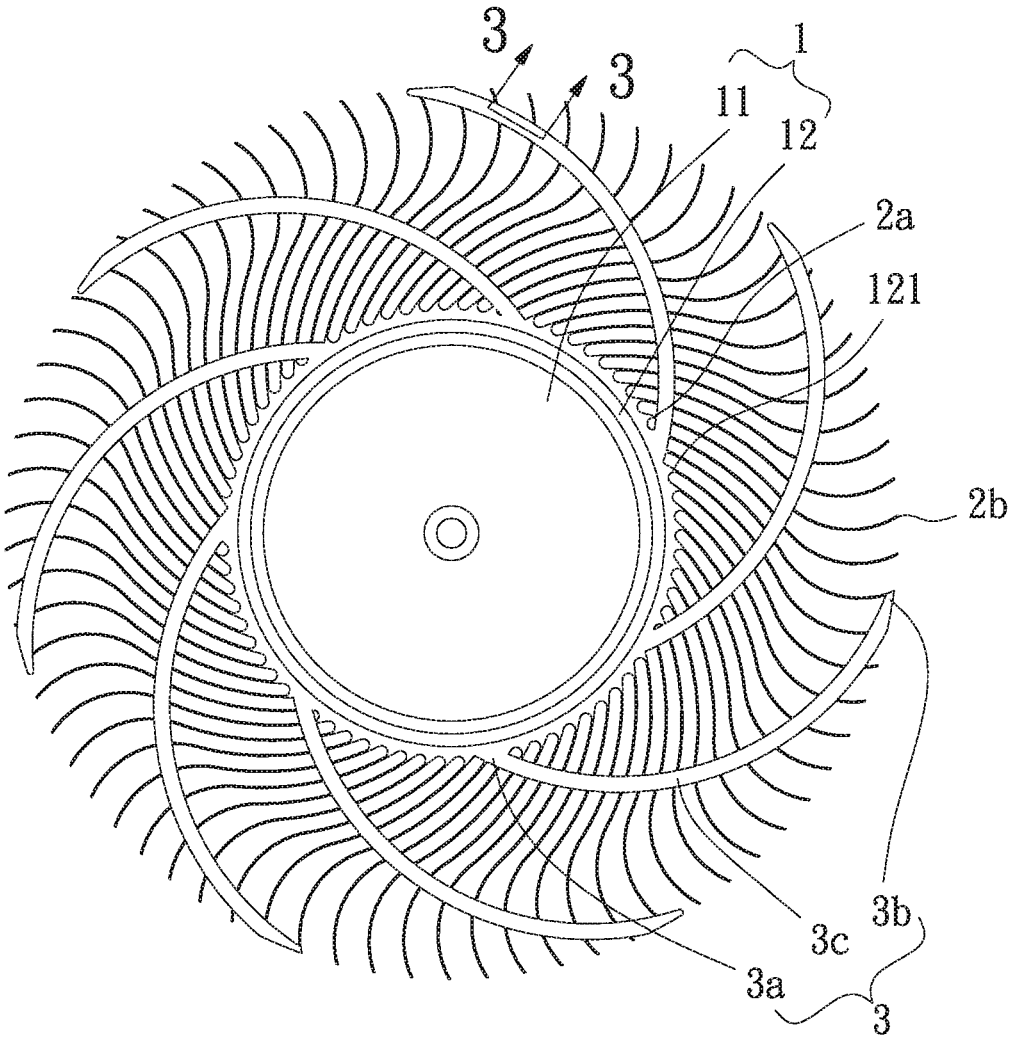
FIG. 2 is a top view of the impeller of the first embodiment of the invention.
Figure 3:
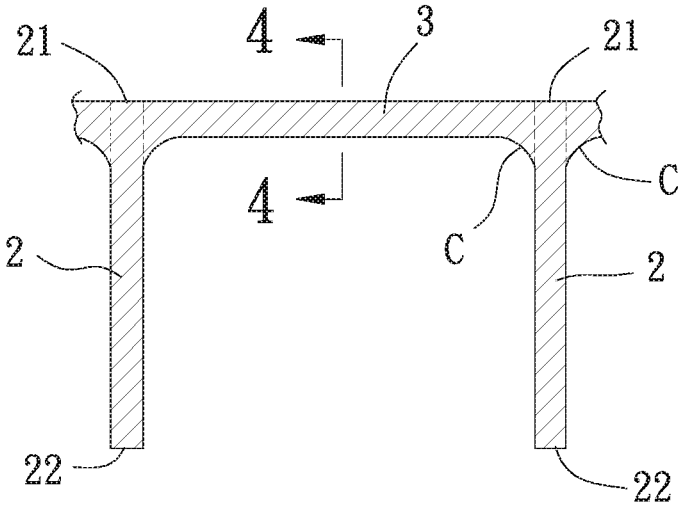
FIG. 3 is a cross sectional view of the blade and the rib taken along line 3-3 of FIG. 2.
Figure 4:
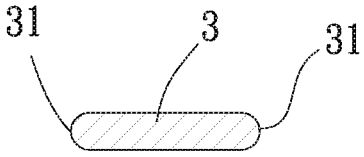
FIG. 4 shows the rib taken along line 4-4 of FIG. 3.

Referring to FIGS. 2, 3 and 4, the plurality of ribs 3 can extend from the outer periphery of the hub 1 to connect to the plurality of blades 2. In this regard, each blade 2 intersects with at least one of the plurality of ribs 3. The use of the plurality of ribs 3 secures the plurality of blades 2 in position, preventing shaking or deformation of the plurality of blades 2 resulting from the air resistance. Specifically, each rib 3 has a connecting end 3*a* and a protruding end 3*b* opposite to the connecting end 3*a*. The connecting end 3*a* is engaged with the hub 1. The protruding end 3*b* can extend in a direction in which the second end 2*b* of the blade 2 extends. A fixed section 3*c* forms between the connecting end 3*a* and the protruding end 3*b* and is connected to the plurality of blades 2. The fixed section 3*c* can be in a linear form (not shown), such that the fixed section 3*c* extends straight towards a virtual boundary delimited by the second ends 2*b* of the plurality of blades 2. Alternatively, the fixed section 3*c* is in a curved form in this embodiment. As compared with the linear form, the curved rib 3 can connect with a wider range of the blades 2 as the rib 3 is in a similar shape to the circular shape of the impeller. Thus, the rib 3 can connect to a larger number of the blades 2 to further reinforce the plurality of blades 2. The rib 3 is preferably not parallel to the blade 2 to ensure intersection between the blade 2 and at least one of the plurality of ribs 3.

It is noted that the plurality of ribs 3 can be connected to the first blade edges 21 or the second blade edges 22 of the blades 2 in a protrusive manner that the plurality of ribs 3 is partially or entirely protrusive from the first blade edges 21 or the second blade edges 22 of the blades 2 in an axial direction of the impeller. Alternatively, the connecting ends 3*a* of the ribs 3 is connected to the extension portion 121 of the lateral wall 12, such that the plurality of ribs 3 extends away from the hub 1 from the extension portion 121 of the hub 1. In this regard, the plurality of ribs 3 penetrates the portions of the blades 2 between the first blade edges 21 and the second blade edges 22 of the blades 2 to reduce the thickness of the fan, thus forming a slim fan. In this embodiment, the plurality of ribs 3 is connected to the first blade edges 21 or the second blade edges 22 of the blades 2 in a manner that one surface (top surface or bottom surface) of the rib 3 is flush with the first blade edges 21 or the second blade edges 22 of the blades 2. Furthermore, each interconnected part of the rib 3 and the blade 2 is preferably in the form of a curved face or a slanted face C, such that the rib 3 and the blade 2 would have a larger contact area to reinforce the engagement therebetween. Moreover, the fixed section 3*c* has a top surface and a bottom surface opposite to the top surface in an axial direction; as such, the fixed section 3*c* has two lateral surfaces opposite to each other along a plane perpendicular to the axial direction. In this regard, each of the two lateral surfaces is an arched surface 31. When the rib 3 is partially or entirely protrusive from the first blade edges 21 or the second blade edges 22 of the blades 2 in the axial direction of the impeller, each arched surface 31 extends along the entire fixed section 3*c* of the rib 3. When the rib 3 penetrates the portions of the blades 2 between the first blade edges 21 and the second blade edges 22 of the blades 2, each arched surface 31 extends along the portions of the fixed section 3*c* that are connected between two blades 2. In this structure, when the rib 3 is adjacent to the windward position of the blade 2, the rib 3 is able to guide the air to flow. This advantageously lowers the undesired air-blocking effect of the rib 3. Also, the fixed section 3*c* between two blades 2 can extend from the first blade edges 21 of the two blades 2 towards the second blade edges 22 of the two blades 2, thereby securing the plurality of blades 2 in position.

The plurality of ribs 3 that is disposed within the extent of the plurality of blades 2 can be in any quantity that keeps the plurality of blades 2 in a balance condition, thus avoiding shaking of the impeller during the rotation. For example, the quantity of the plurality of ribs 3 may be two, in which the two ribs 3 are respectively located at two sides of the hub 1. In this situation, each of the two ribs 3 can connect with at least a half of the number of the plurality of blades 2 to ensure that each blade 2 interconnects with at least one of the plurality of ribs 3. Furthermore, at least one of the plurality of blades 2 intersects with two or more of the plurality of ribs 3. This further secures the plurality of blades 2 in position.

Figure 5:
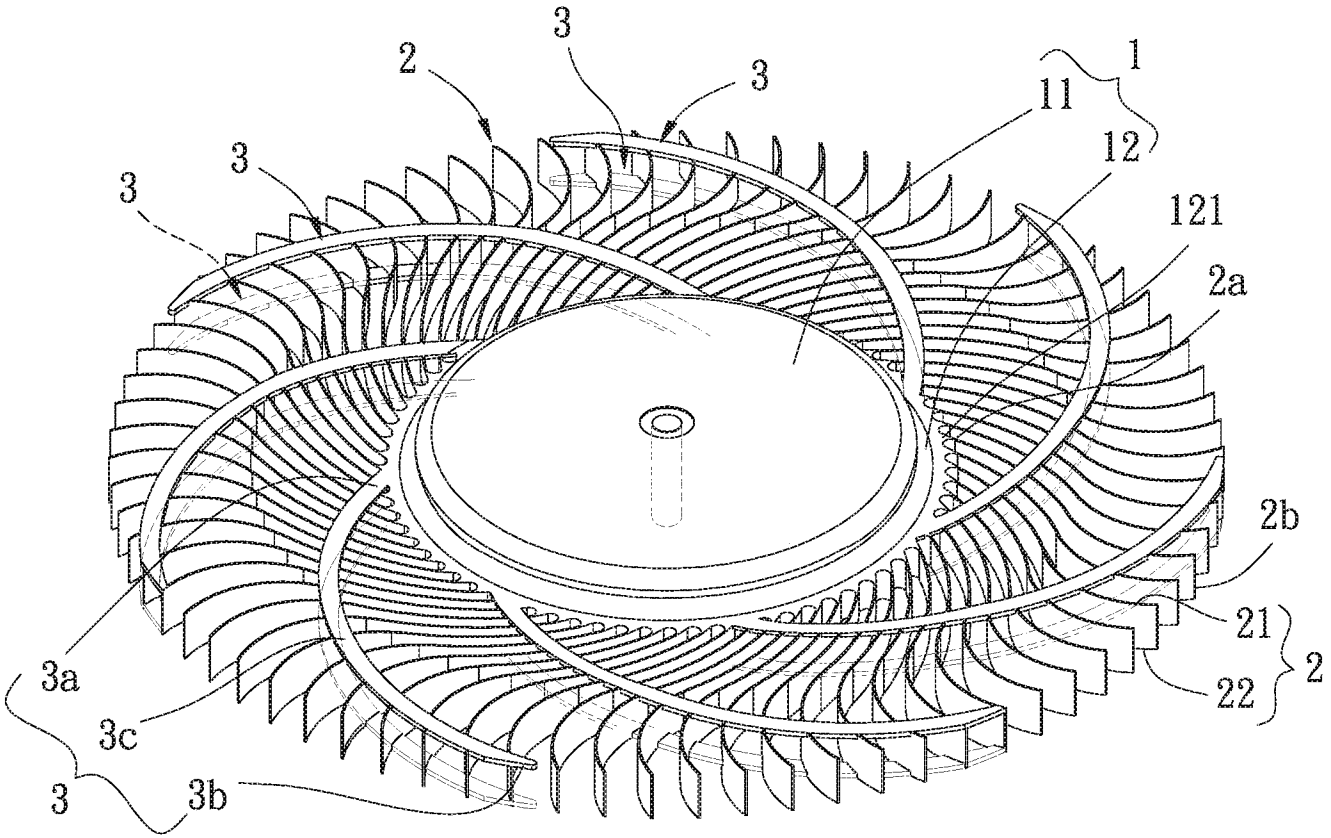
FIG. 5 is a perspective view of an impeller according to a second embodiment of the invention.

FIG. 5 shows an impeller according to a second embodiment of the invention. The plurality of ribs 3 can be connected to both the first blade edges 21 and the second blade edges 22 of the plurality of blades 2 in a protrusive manner that the plurality of ribs 3 is partially or entirely protrusive from the first blade edges 21 and the second blade edges 22 of the plurality of blades 2 in an axial direction of the impeller. Alternatively, one surface (top surface or bottom surface) of each rib 3 is flush with the first blade edges 21 or the second blade edges 22 of the plurality of blades 2. Furthermore, the rib(s) 3 that is connected to the first blade edges 21 is aligned with or staggered from the rib(s) 3 that is connected to the second blade edges 22. The invention is not limited to either option.

Figure 6:
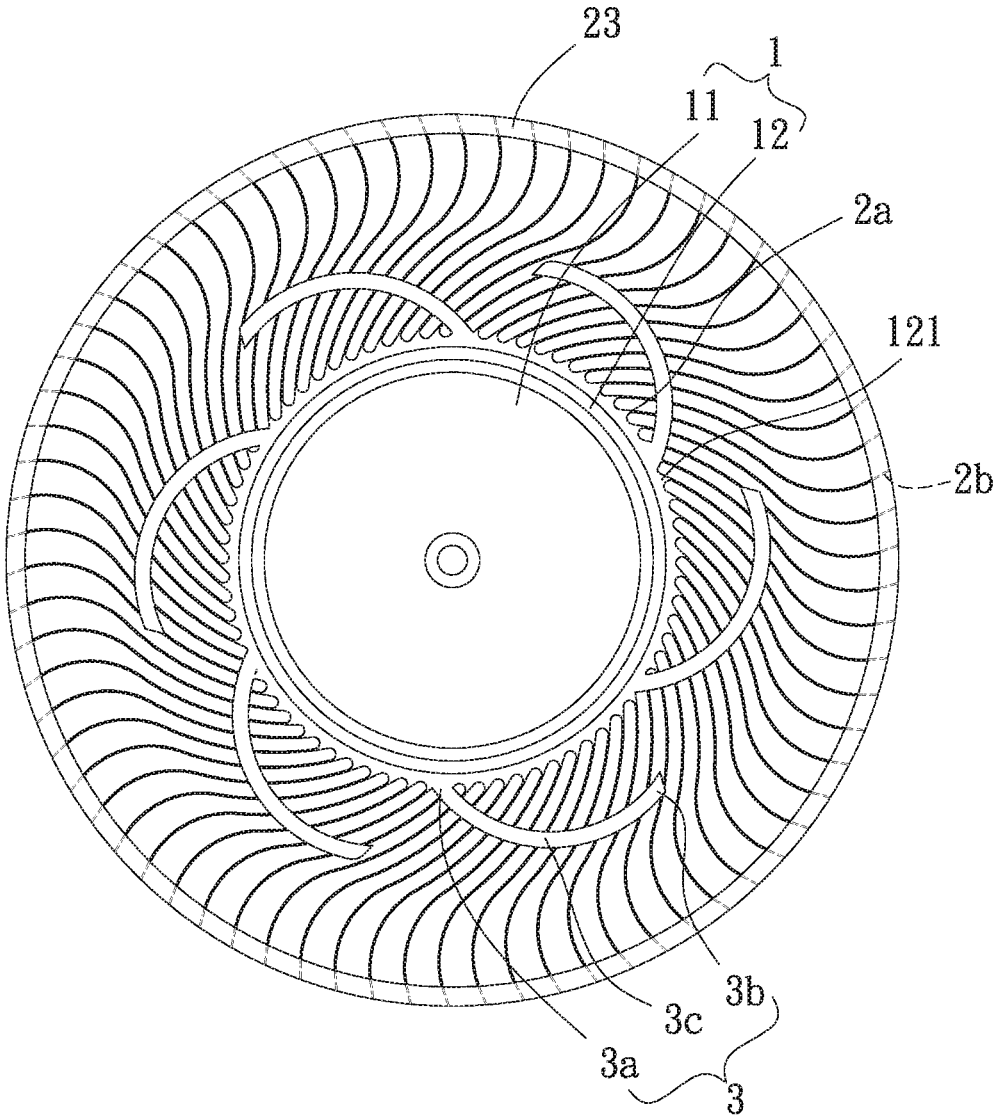
FIG. 6 is a top view of an impeller according to a third embodiment of the invention.

FIG. 6 shows an impeller according to a third embodiment of the invention. The protruding end 3*b* of the rib 3 is located between the outer periphery of the hub 1 and the second ends 2*b* of the plurality of blades 2. The radial extension length of the plurality of ribs 3 over the plurality of blades 2 is reduced, thereby increasing the windward areas of the plurality of blades 2 under the interconnection between the blade 2 and at least one of the plurality of ribs 3. Advantageously, the balance between the stability and the air volume of the plurality of blades 2 is maintained. In this embodiment, the ratio of the radial distance, which is measured from the lateral wall 12 of the hub 1 to the protruding end 3*b* of the rib 3, to the radial distance from the lateral wall 12 to the second end 2*b* of the blade 2, is 0.3~1. Furthermore, an annular rib 23 can be connected to the second ends 2*b* of the plurality of blades 2 to thereby prevent shaking of the plurality of blades 2 at the second ends 2*b* thereof.

Table 1 shows the results of the air pressure and air volume measured from different types of the fan under the same level of noise in an electronic device, including a type 1 of the fan having the impeller not provided with the plurality of ribs 3 as is the case of a conventional fan, a type 2 of the fan having the impeller provided with the plurality of ribs 3 as is arranged in the third embodiment above, and a type 3 of the fan having the impeller provided with the plurality of ribs 3 as is arranged in the first embodiment above.

TABLE 1

Results of Air Volume Under Different Static Pressure

| Without ribs (first type of the fan) | | With ribs (second type of the fan) | | With ribs (third type of the fan) | |
|---|---|---|---|---|---|
| Static Pressure (mmAq) | Air volume (CFM) | Static Pressure (mmAq) | Air volume (CFM) | Static Pressure (mmAq) | Air volume (CFM) |
| 6.77 | 0 | 7.12 | 0 | 7.08 | 0 |
| 5.74 | 0.398 | 6.07 | 0.472 | 6.07 | 0.443 |
| 4.23 | 1.013 | 4.40 | 1.228 | 4.45 | 1.156 |
| 2.31 | 1.606 | 2.52 | 1.853 | 2.64 | 1.764 |
| 0 | 2.315 | 0 | 2.466 | 0 | 2.344 |

Referring to Table 1, as compared with the conventional fan which the impeller thereof is not provided with the ribs, it can be observed from the results, which are measured under the same level of noise in the electronic device, that the impeller with the use of the ribs according to the invention does secure the blades in position to increase the air volume.

In summary, the plurality of blades of the impeller according to the invention can be secured in position through the interconnection between the blade and at least one rib that extends from the outer periphery of the hub and connects to the blades, preventing shaking or deformation of the plurality of blades resulting from the air resistance during the rotation of the impeller. It is noted that, as compared with the conventional impeller where the free ends of the blades are interconnected by a ring, the plurality of ribs of the impeller according to the invention extends from the hub and has connecting ends coupled with the hub. As such, the strength of the plurality of ribs is improved to better secure the plurality of blades in position, thereby reducing the noise and improving the cooling performance of the fan.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An impeller comprising:

a hub;

a plurality of blades coupled with the hub; and a plurality of ribs connected to the plurality of blades, wherein each of the plurality of ribs has a connecting end coupled with the hub, wherein each of the plurality of blades intersects with at least one of the plurality of ribs, wherein each of the plurality of ribs is connected to at least two of the plurality of blades, and wherein a number of the plurality of ribs is smaller than a number of the plurality of blades.

2. The impeller as claimed in claim 1, wherein each of the plurality of blades has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein the plurality of ribs is located between the first blade edges and the second blade edges of the plurality of blades.

3. The impeller as claimed in claim 2, each of the plurality of ribs has a protruding end opposite to the connecting end and extending in a direction in which the second end of the blade extends, wherein each of the plurality of ribs further includes a fixed section between the connecting end and the protruding end of the rib, and wherein the fixed section is in a linear form and is connected to a portion of the plurality of blades.

4. The impeller as claimed in claim 2, wherein each of the plurality of ribs has a protruding end opposite to the connecting end and extending in a direction in which the second end of the blade extends, wherein each of the plurality of ribs further includes a fixed section between the connecting end and the protruding end of the rib, and wherein the fixed section is in a curved form and is connected to a portion of the plurality of blades.

5. The impeller as claimed in claim 4, wherein the fixed section has a top surface and a bottom surface opposite to the top surface in an axial direction, wherein the fixed section has two lateral surfaces opposite to each other along a plane perpendicular to the axial direction, and wherein each of the two lateral surfaces is an arched surface.

6. The impeller as claimed in claim 4, wherein the protruding end of each of the plurality of ribs is located between the hub and the second ends of the plurality of blades.

7. The impeller as claimed in claim 6, wherein a ratio of a radial distance, which is measured from a lateral wall of the hub to the protruding end of each of the plurality of ribs, to a radial distance from the lateral wall of the hub to the second end of one of the plurality of blades, ranges from 0.3 to 1.

8. The impeller as claimed in claim 4, wherein the fixed section extends from the first blade edges of the portion of the plurality of blades towards the second blade edges of the portion of the plurality of the blades.

9. The impeller as claimed in claim 2, further comprising an annular rib connected to the second ends of the plurality of blades.

10. The impeller as claimed in claim 2, wherein each of the plurality of ribs is connected to at least one of the plurality of blades, and wherein the plurality of ribs is connected to the first blade edge or the second blade edge of the blades.

11. The impeller as claimed in claim 10, wherein the each of the plurality of ribs is connected to the at least one of the plurality of blades in a manner that one surface of the rib is flush with the first blade edge or the second blade edge of each of the at least one of the plurality of blades.

12. The impeller as claimed in claim 1, wherein each of the plurality of blades has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein each of the plurality of ribs is connected to at least one of the plurality of blades in a manner that the rib is partially or entirely protrusive from the first blade edge or the second blade edge of each of the at least one of the plurality of blades in an axial direction of the impeller.

13. The impeller as claimed in claim 1, wherein each of the plurality of blade has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein the plurality of ribs is connected to the first blade edges and the second blade edges of the plurality of blades.

14. The impeller as claimed in claim 13, wherein the plurality of ribs includes at least one first rib connected to the first blade edges of a portion of the plurality of blades, as well as at least one second rib connected to the second blade edges of the portion of the plurality of blades, and wherein the at least one first rib is aligned with the at least one second rib.

15. The impeller as claimed in claim 13, wherein the plurality of ribs includes at least one first rib connected to the first blade edges of a portion of the plurality of blades, as well as at least one second rib connected to the second blade edges of the portion of the plurality of blades, and wherein the at least one first rib is staggered from the at least one second rib.

16. The impeller as claimed in claim 1, wherein each of the plurality of blades intersects with at least two of the plurality of ribs.

17. The impeller as claimed in claim 1, wherein each of the plurality of blades has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein each of the plurality of ribs is connected to at least two of the first blade edges.

18. The impeller as claimed in claim 1, wherein each of the plurality of blades has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein each of the plurality of ribs is connected to at least two of the second blade edges.

19. The impeller as claimed in claim 1, wherein each of the plurality of blades has a first end and a second end, wherein the first ends of the plurality of blades are coupled with the hub, wherein each of the plurality of blades has a first blade edge and a second blade edge opposite to the first blade edge, wherein the first blade edge and the second blade edge of each of the plurality of blades are located between the first end and the second end of the blade, and wherein a part of the plurality of ribs are connected to at least two of the first blade edges, and others of the plurality ribs are connected to at least two of the second blade edges.

* * * * *